US007937909B2

(12) United States Patent
Carvallo

(10) Patent No.: US 7,937,909 B2
(45) Date of Patent: May 10, 2011

(54) METHOD FOR CREATING A PACKAGE PRESSURE DIFFERENTIAL

(75) Inventor: Raquel Carvallo, Tampa, FL (US)

(73) Assignee: James A. Donovan, Tarpon Springs, FL (US)

( * ) Notice: Subject to any disclaimer, the term of this patent is extended or adjusted under 35 U.S.C. 154(b) by 175 days.

(21) Appl. No.: 12/215,802

(22) Filed: Jun. 30, 2008

(65) Prior Publication Data

US 2009/0320411 A1 Dec. 31, 2009

(51) Int. Cl.
*B65B 31/00* (2006.01)
*F24J 1/00* (2006.01)

(52) U.S. Cl. ..... 53/433; 53/453; 53/511; 53/559; 126/263.07; 126/263.08; 206/219; 206/524.8; 607/114

(58) Field of Classification Search ..... 53/432, 53/433, 453, 454, 479, 511, 559, 122, 111 RC, 53/561; 126/263.05–263.09; 206/219, 524.8; 607/114

See application file for complete search history.

(56) References Cited

U.S. PATENT DOCUMENTS

| | | | | | |
|---|---|---|---|---|---|
| 2,623,515 | A | * | 12/1952 | Sukacev | 126/263.05 |
| 2,907,173 | A | * | 10/1959 | Robbins | 126/263.07 |
| 2,925,719 | A | * | 2/1960 | Robbins et al. | 206/219 |
| 3,342,324 | A | * | 9/1967 | Piazze | 206/219 |
| 3,573,069 | A | * | 3/1971 | Keller et al. | 206/219 |
| 3,640,047 | A | * | 2/1972 | Brignall | 53/453 |
| 3,683,889 | A | * | 8/1972 | Hoffman | 126/263.07 |
| 3,763,622 | A | * | 10/1973 | Stanley, Jr. | 607/114 |
| 3,865,117 | A | * | 2/1975 | Perry, III | 607/114 |
| 3,874,504 | A | * | 4/1975 | Verakas | 206/219 |
| 3,887,346 | A | * | 6/1975 | Erdman | 62/4 |
| 4,000,996 | A | * | 1/1977 | Jordan | 206/219 |
| 4,067,313 | A | * | 1/1978 | Donnelly | 206/219 |
| 4,085,565 | A | * | 4/1978 | Mahaffy et al. | 53/511 |
| 4,263,767 | A | * | 4/1981 | Kyle | 53/51 |
| 4,277,931 | A | * | 7/1981 | Mahaffy et al. | 53/433 |
| RE32,383 | E | * | 3/1987 | Banks et al. | 53/453 |
| 4,656,042 | A | * | 4/1987 | Risler | 53/453 |
| 4,856,651 | A | * | 8/1989 | Francis, Jr. | 206/219 |
| 5,103,618 | A | * | 4/1992 | Garwood | 53/433 |
| 5,115,624 | A | * | 5/1992 | Garwood | 53/433 |
| 5,220,909 | A | * | 6/1993 | Pickard et al. | 126/263.08 |
| 5,984,953 | A | * | 11/1999 | Sabin et al. | 607/114 |
| 5,984,995 | A | * | 11/1999 | White | 126/263.05 |
| 6,378,274 | B1 | * | 4/2002 | Harbour | 53/453 |
| 6,494,023 | B2 | * | 12/2002 | DelDuca et al. | 53/511 |
| 6,644,383 | B2 | * | 11/2003 | Joseph et al. | 165/46 |
| 2002/0098113 | A1 | * | 7/2002 | Nakagawa et al. | 206/524.8 |
| 2002/0170832 | A1 | * | 11/2002 | Klair | 206/219 |
| 2004/0112367 | A1 | * | 6/2004 | Zaninelli | 126/263.07 |

(Continued)

FOREIGN PATENT DOCUMENTS

| | | | | |
|---|---|---|---|---|
| EP | 0015461 | * | 9/1980 | 53/453 |

(Continued)

*Primary Examiner* — Stephen F Gerrity
(74) *Attorney, Agent, or Firm* — Kinney & Lange, P.A.

(57) ABSTRACT

A method for making a two component device where the two components are in separate containers with one container inside the other. The method includes placing a first container between the top and bottom of a second container in a die that draws a vacuum between the top and bottom of the second container when they are sealed to form the container. The vacuum preferably ranges from about 8 to about 13 psi. The two components are selected to react to achieve a result, such as the generation of heat.

13 Claims, 2 Drawing Sheets

U.S. PATENT DOCUMENTS

| | | | | |
|---|---|---|---|---|
| 2005/0283212 | A1* | 12/2005 | Caceres et al. | 607/114 |
| 2006/0005827 | A1* | 1/2006 | Consoli et al. | 126/263.06 |
| 2007/0289720 | A1* | 12/2007 | Sunol et al. | 165/80.5 |
| 2008/0097356 | A1 | 4/2008 | Donovan | |
| 2009/0277915 | A1* | 11/2009 | Ferguson | 220/592.27 |

FOREIGN PATENT DOCUMENTS

| | | | |
|---|---|---|---|
| JP | 61217650 | A * | 9/1986 |
| JP | 61231352 | A * | 10/1986 |
| WO | WO 9110102 | A1 * | 7/1991 |

* cited by examiner

METHOD FOR CREATING A PACKAGE PRESSURE DIFFERENTIAL

BACKGROUND

This invention relates to an activation device for activating a two component system where the two components are in separate containers with one container inside the other. An example of such a system is a system for heaters of personal hygiene wipes or cloths used to cleanse various parts of the body. More particularly, the invention relates to an improved activation device package for a personal hygiene wipe or cloth that is temperature controlled to give increased comfort and utility.

Personal hygiene wipes are often used by persons when they are away from their home and do not have access to a shower or bath. They are also used when the part of the person that is to be cleaned is small, and a shower or bath consumes too much time.

In order to be effective, however, personal hygiene wipes need to be warmed or heated in order to more effectively clean the hands or other parts of the user's anatomy. At the present time, warm wipes are only attainable by the use of an external source of hot water, or by inserting the wipes into a microwave or other heating device. This presents a danger as the degree of heating may vary, and it is possible to have excessive heat applied to the skin.

A major drawback of the use of an exothermic reaction to generate heat upon demand is that the various components have to be kept totally separated from each other until they are combined, and when combined need to react quickly and over a reasonable surface area. If the reaction only takes place at one location, excessive heat will be generated. If the reaction components are spread out, there has not been any way to combine them from the dispersed locations to generate uniform exothermic reaction. The problem that occurs is that the heater gives too much heat to part of the object to be heated and too little to other parts.

Yet another drawback to chemical generation of heat is that the reaction depends on adequate mixing that does not happen quickly enough to be useful.

It would be a great advantage if a way of bringing a two component reaction system together to react in a quick and effective manner.

Another advantage would be to provide a way of bringing a two component reaction system together that is controlled and requires a specific action by the user such that the action is not one experienced by the system when carried about prior to use.

Yet another advantage would be to provide a way to activate a heater to generate heat by an exothermic reaction over a personal hygiene wipe sized area quickly, without having to wait for an activation agent to make its way to all the reaction components, and without.

Other advantages will appear hereinafter.

SUMMARY

It has now been discovered that the above and other advantages of the present invention may be accomplished in the following manner. The unique aspect of this invention is the method and apparatus for creating a pressure differential that causes rapid transfer of material from the higher pressure to the lower pressure. Because the present invention has created a higher pressure in the inner package, activation drives the inner container component into the outer container component quickly and over the entire inside of the outer container.

In it's simplest form the invention comprises a two component activation device such as those used for a heater in a package holding personal hygiene wipes. Other two component reaction systems, such as, by way of example and not by way of limitation, are systems where the reaction absorbs heat or effectively provides a cooling effect. Another example of a two component system is one that keeps an adhesive such as an epoxy resin separate from the catalyst that causes it to react until the time for bonding something is at hand. Cosmetics, edible products, medicines and diet supplements are other examples of products that it may be desirable to mix quickly, particularly mixing a solid and a liquid.

The method and apparatus of this invention provides for a simple and effective way to create a vacuum in the outer container while the inner container remains at atmospheric pressure so that when the inner container is opened, by piercing or other means, the contents in the inner container are drawn rapidly into the outer container because of the vacuum in the outer container.

DETAILED DESCRIPTION

Figure 1:
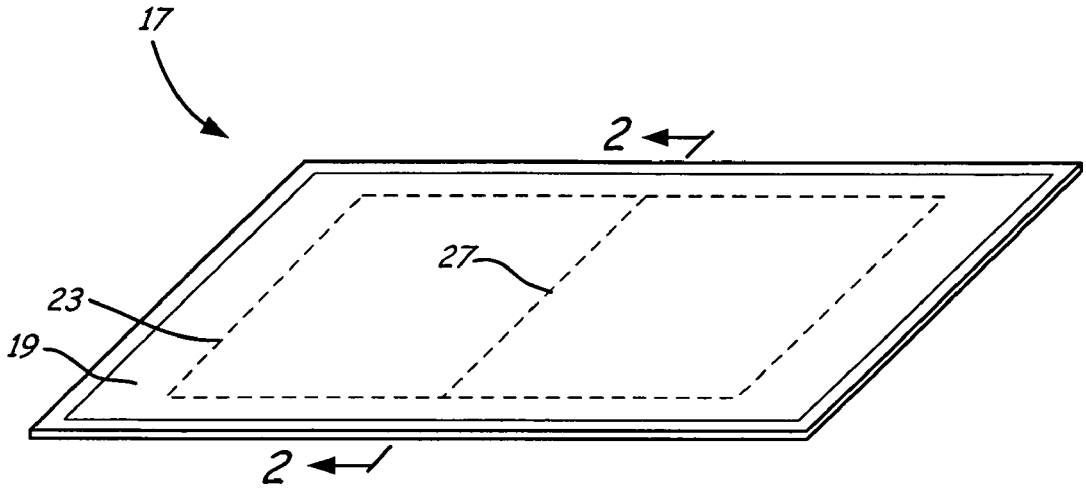
FIG. 1 is a perspective view of the device of this invention.
Figure 2:
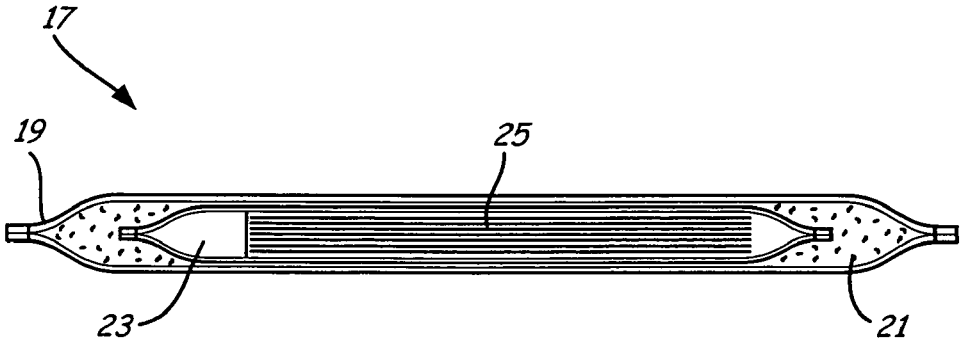
FIG. 2 is a section view taken along line 2-2 of FIG. 1

The present invention provides a method of making a sealed package or container with a vacuum inside. Such a device is used in a two component package, 17 generally, as shown in FIG. 1. Package 17 includes an outer container 19 having a first reaction component 21 therein. Also inside the outer container 19 is inner container 23 having a second reaction component 25 therein. Part of the inner container 23 is an activation element 27 that functions to break or rupture inner container 23 so that it's contents can be transferred to the outer container 19.

In order to have a uniform and even mixing of the two reaction components, it is preferred that the inside of inner pouch 23 be at atmospheric pressure or 14.7 psi, and the inside of the outer pouch 19 be under vacuum. Preferred pressures in outside pouch 19 are from about 8 psi to about 13 psi, with 10 or 11 psi being preferred. It is necessary to have a pressure differential between the inside of both pouches to be sufficient to pull the activating agent 25 to the entire area where the heat generating material 21 has been placed. Too little or too great a pressure differential is not desired, for design and reliability reasons.

Figure 3:
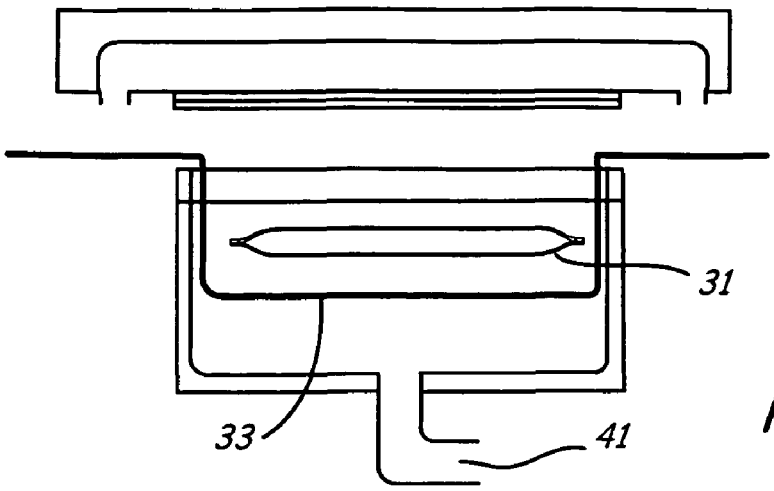
FIGS. 3, 4 and 5 are a schematic views of a die used in the present invention showing the progression of steps forming the product of this invention.
Figure 4:
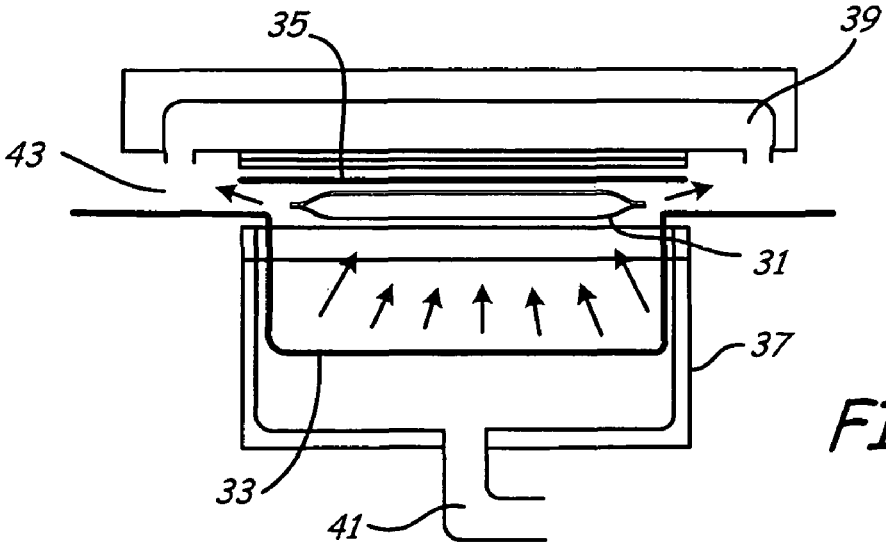
Figure 5:
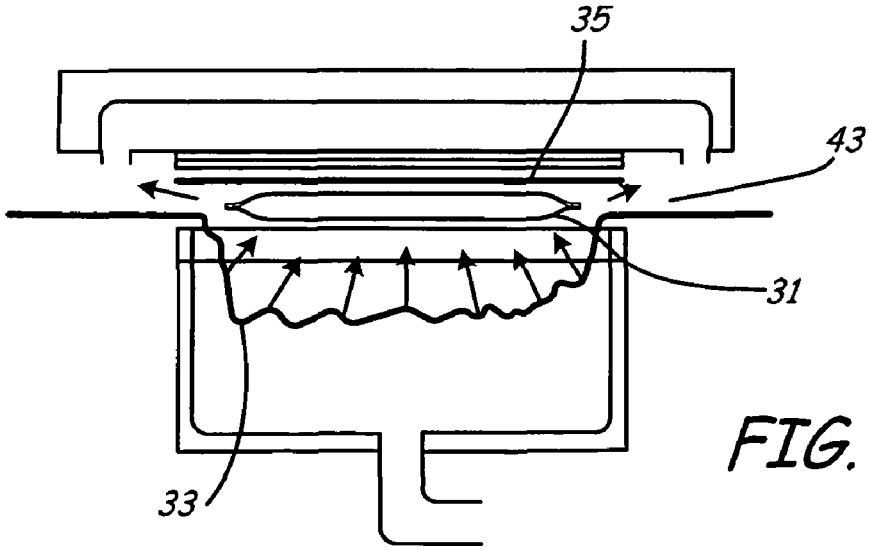

As shown in FIG. 3, the pressure differential between an outer pouch and an inner pouch is accomplished in the following manner. After it has been filled with its contents, which is water in the example used herein, pouch 31 is placed inside the bottom portion 33 of what will become the outer pouch. The upper portion 35 is placed above pouch 31. Lower die 37 supports part of bottom portion 33 and upper die 39 holds top portion 35 of the to be assembled outer pouch, such as pouch 19 in FIG. 1.

The top web 35 is narrower than the bottom 33, so that the edge of the top film 35 is between the upper vacuum chamber 43 and the seal plate allowing for package vacuum to be pulled from the top. The amount of upper vacuum is not critical as its function is to hold down the top portion 35 so it does not tact off on the seal plate. Bottom or package vacuum 41 is them turned on to evacuate the package of air, when this is accomplished, based on time and the size vacuum pump the top seal plate of die 39 is fired and the package is sealed off. The amount of vacuum is controlled by a vacuum sensor, not shown, as in some cases, full vacuum is not necessary. It is preferred that the lower vacuum be on and die 37 and upper die 39 come together to form the second container in less than one second. This quick forming reduces any effect of the vacuum on the contents of the second container. When the tools open and the die portions are separated, the package collapses as it is then vented to atmosphere.

There are a number of combinations of heat generating materials and activating agents that are suitable for use in the present invention. The selection of specific components is to be based upon cost, compatibility, ease of control of the exotherm, and other factors.

In the chamber between bottom die 37 upper die 39 prior to opening to atmosphere there is no turbulence. However, since the chamber does have vacuum, water or high volume liquid products that will boil at or beyond 29" of mercury should not be in what becomes outer pouch 19. Evacuation time should be accomplished as quickly as possible to eliminate moisture from contaminating the seals between lower and upper portions 33 and 35 respectively as they are joined together.

The primary purpose of vacuum in the outer pouch 19 is to cause the contents of inner pouch 23 to move into the outer pouch 19 when the seal between them is broken. In addition, vacuum in the outer pouch 19 removes oxygen from the package 19 to prevent degradation of product. The vacuum also serves to hold the product in position and reduce stress on the seal of package or pouch 19 when exposed to high altitude such as encountered on travels in mountains.

The preferred activating material of this invention is water. This is plentiful and safe, and reacts with a number of materials to produce an exothermic reaction.

The preferred heat generating material is a crystal that, when free from moisture, is stable for up to three to five years or more, and which react when moisture is present to generate heat. The preferred crystal is made from crystalline calcium oxide. Calcium oxide is commercially available from a number of sources, one of which being Calcium Oxide Fisher Scientific S79946. For efficient integration of this component into the fabric, the calcium oxide is ground into small particles or crystals and a sieve is used to insure uniform particle size.

In a series of tests of the preferred embodiment as described above using water to react with calcium oxide, 100% of the activations by bending the packages resulted in warm personal hygiene wipes. Then a similar set of packages were prepared, with the only change being no vacuum inside the outer pouch, only 30% of the wipes achieved the desired temperature.

It is also an embodiment of the present invention to employ a temperature changing chemical that causes a drop in temperature when contacted by water, creating an endothermic reaction. The solid materials may, for example, include materials such as sodium sulfate*$10H_2O$; sodium bicarbonate, ammonium nitrate, ammonium chloride, urea, ammonium dichromate, citric acid, potassium perchlorate, potassium sulfate, potassium chloride, calcium nitrate, and vanillin. These solid compounds react with water in an endothermic fashion to impart cooling. Reactions can be with water based mixtures as well as other liquid systems. Other uses of the activation of a two component reaction system.

Although the present invention has been described with reference to preferred embodiments, workers skilled in the art will recognize that changes may be made in form and detail without departing from the spirit and scope of the invention.

The invention claimed is:

1. A method for making a two component system, comprising the steps of:

forming a first container having a first component therein;

placing a first and second portion of a second container in a die for forming a second container including a second component, the first container being positioned between the first and second portions of the second container and the die having an upper and lower portion adapted to come together; and drawing a vacuum in the lower portion of the die while moving the upper and lower portions together to seal the first and second portions of the second container together to form the second container with a vacuum pressure inside, the first container remaining inside the second container and having atmospheric pressure inside.

2. The method of claim 1, wherein vacuum inside the second container is sufficient to give a pressure of from about 8 to 13 psi.

3. The method of claim 1, wherein vacuum inside the second container is sufficient to give a pressure of from about 10 to 11 psi.

4. The method of claim 1, with the additional step of drawing a first vacuum in the upper portion of the die to retain the first portion of the second container on the upper portion of the die prior to forming the second container.

5. The method of claim 1, wherein the upper and lower portions of the die are moved to form the second container with the vacuum in less than one second.

6. The method of claim 1, wherein the first portion of the second container is smaller than the second portion so that the second portion forms the edge of the container.

7. The method of claim 1, wherein the first container component is a liquid and the second container component is a solid, whereby contact by the liquid on the solid initiates a reaction.

8. The method of claim 7, wherein the liquid is water and the solid is crystalline calcium oxide.

9. A method for making a two component system, comprising the steps of:

forming a first container having a first component therein;

placing a first and second portion of a second container in a die for forming a second container including a second component, the first container being positioned between the first and second portions of the second container and the die having an upper and lower portion adapted to come together;

drawing a first vacuum in the upper portion of the die to retain the first portion of the second container on the upper portion of the die; and drawing a second vacuum in the lower portion of the die while moving the upper and lower portions together to seal the first and second portions of the second container together to form the second container with a vacuum pressure inside of from about 8 psi to about 13 psi, the first container remaining inside the second container and having atmospheric pressure inside.

10. The method of claim 9, wherein the upper and lower portions of the die are moved to form the second container with the vacuum in less than one second.

11. The method of claim 9, wherein the amount of vacuum in the first container is sufficient to give a pressure of from about 10 to 11 psi.

12. The method of claim 9, wherein the first container component is a liquid and the second container component is a solid, whereby contact by the liquid on the solid initiates a reaction.

13. The method of claim 12, wherein the liquid component is water and the solid component is crystalline calcium oxide.

* * * * *

UNITED STATES PATENT AND TRADEMARK OFFICE

CERTIFICATE OF CORRECTION

PATENT NO. : 7,937,909 B2
APPLICATION NO. : 12/215802
DATED : May 10, 2011
INVENTOR(S) : Raquel Carvallo and Aydin K. Sunol It is certified that error appears in the above-identified patent and that said Letters Patent is hereby corrected as shown below:

On the Title Page,
Item [75], Inventor, please add the following:
--Aydin K. Sunol, Lutz, FL (US)--

Signed and Sealed this
Twenty-third Day of October, 2012

David J. Kappos

David J. Kappos
*Director of the United States Patent and Trademark Office*